United States Patent [19]

Gravestock

[11] Patent Number: 4,655,187

[45] Date of Patent: Apr. 7, 1987

[54] FUEL CONTROL SYSTEM

[75] Inventor: Robert E. Gravestock, Ruislip, Great Britain

[73] Assignee: Lucas Industries Public Limited Company, Birmingham, England

[21] Appl. No.: 782,489

[22] Filed: Oct. 1, 1985

[30] Foreign Application Priority Data

Oct. 13, 1984 [GB] United Kingdom ..... 8425926

[51] Int. Cl.[4] ..... F02D 17/00

[52] U.S. Cl. ..... 123/481; 123/198 F

[58] Field of Search ..... 123/481, 198 F

[56] References Cited

U.S. PATENT DOCUMENTS 4,064,844 12/1977 Matsumoto et al. ..... 123/198 F X
4,176,624 12/1979 Bielecki et al. ..... 123/478 X
4,187,824 2/1980 Connolly ..... 123/198 F
4,227,505 10/1980 Larson et al. ..... 123/198 F
4,434,767 3/1984 Kohama et al. ..... 123/481
4,530,332 7/1985 Harvey et al. ..... 123/481

FOREIGN PATENT DOCUMENTS 2122682 1/1984 United Kingdom ..... 123/481

*Primary Examiner*—Tony M. Argenbright
*Attorney, Agent, or Firm*—Balogh, Osann, Kramer, Dvorak, Genova & Traub

[57] ABSTRACT

A fuel control system for the fuel supply system of a compression ignition engine is arranged so that above a predetermined engine speed and below a predetermined level of fuel supply, fuel supply to the combustion chambers of the engine in turn is prevented. The remaining combustion chambers are arranged to receive an increased fuel supply to maintain the engine power.

4 Claims, 2 Drawing Figures

FUEL CONTROL SYSTEM

Figure 1:
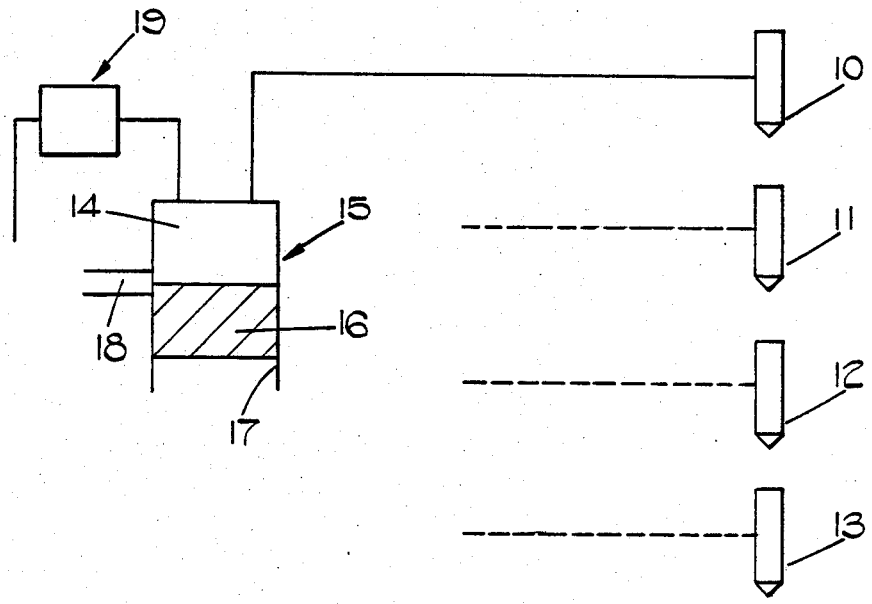

This invention relates to a fuel control system for a fuel supply system for a multi-cylinder internal combustion engine of the compression ignition type, the fuel supply system including an electromagnetically operated valve or valves which is/are operated to cause fuel to be supplied to the combustion chambers of the associated engine.

As the speed of the engine increases the valve or valves are operated at an increasing frequency and although the time interval in terms of degrees of engine crankshaft rotation during which the valves are operated, will remain substantially the same assuming a constant fuel level, the time interval in real terms becomes smaller. The valves require a predetermined time to move to and from their operated state and as a result it becomes increasingly difficult as the engine speed increases, to control the valve or valves in a manner to guarantee accurate fuel control. The situation is aggravated if the amount of fuel which it is required to deliver to the engine is reduced because as the quantity of fuel which is delivered to the engine is reduced the time that the valve or valves remain in their operative state is reduced. Moreover, it is found that if for example the valve is closed in its operative state, some delivery of fuel will occur before the valve reaches its fully closed position and delivery of fuel will continue after the valve has started to open.

It has been proposed in the art of internal combustion engines to cut out certain cylinders of an engine during particular engine operating conditions. This measure may be to achieve fuel economy or control of noxious gas in the engine exhaust. Such a technique can be used with a compression ignition engine. For example, if one cylinder of an engine is rendered inoperative by stopping its fuel supply, the fuel supply to the remaining cylinders must be increased so as to maintain the power developed by the engine and the valve or valves which are operative to control the supply to the remaining cylinders must be closed for an additional time. However, it has been found that if the supply of fuel to a combustion chamber of a compression ignition engine is cut off and if the duration of cut off extends for more than a few working cycles, the combustion chamber will cool to the extent that when the supply of fuel is resumed, poor combustion of the fuel will take place resulting in the emission of noxious gases, until the combustion chamber attains its correct operating temperature.

The object of the present invention is to provide a fuel control system of the kind specified in a simple and convenient form.

According to the invention a fuel control system for the purpose specified includes means operable when the operating parameters of the engine lie within a predetermined range, to prevent supply of fuel to the combustion chambers of the engine in turn and to increase the supply of fuel to the remaining combustion chambers whereby the operated times of the valve or valves are extended.

According to a further feature of the invention a fuel control system for the purpose specified comprises first means responsive to engine position signals and to a fuel demand signal for providing a sequence of control signals for said valve or valves, second means acting when the engine operating parameters lie within a predetermined range to modify said fuel demand signal and to provide a status signal and third means responsive to said status signal for interrupting the sequence of control signals applied to said valve or valves whereby the supply of fuel to the combustion chambers in turn will be prevented, the modified fuel demand signal ensuring that the remaining combustion chambers recieve an increased amount of fuel.

Figure 2:
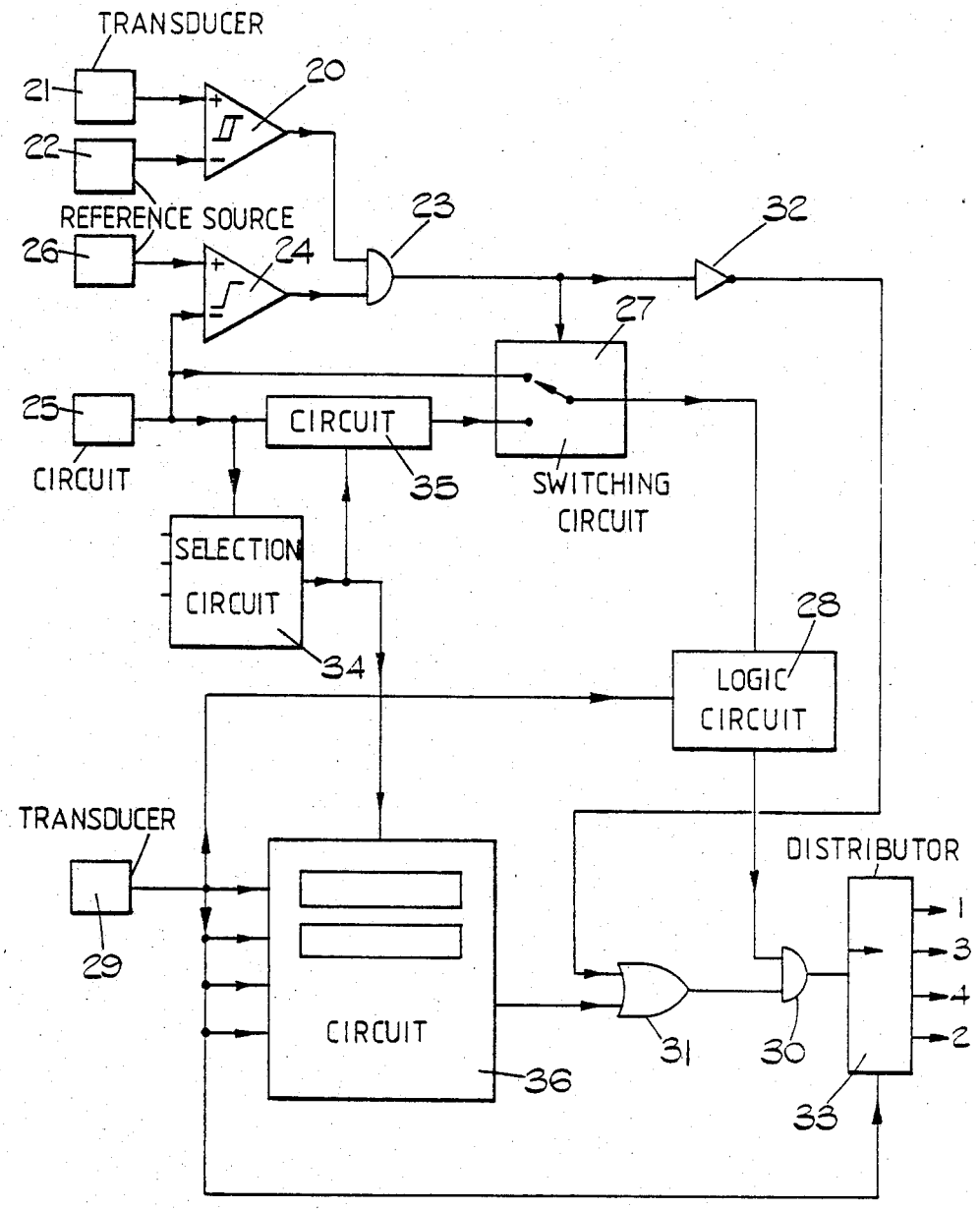

In the accompanying drawings:

FIG. 1 is a diagrammatic representation of the hydraulic portion of a fuel system, and FIG. 2 is a block diagram of the fuel control system.

Referring to FIG. 1 of the drawings, the injection nozzles 10, 11, 12, 13 of a four cylinder compression ignition engine are illustrated. Considering the injection nozzle 10, its inlet is connected to the pumping chamber 14 of a high pressure pump generally indicated at 15 and which includes a plunger 16 reciprocable within a bore 17. The plunger is actuated by means of a cam driven in timed relationship with the associated engine. Formed in the wall of the bore 17 is a fuel inlet port 18 which is connected to a source of fuel (not shown) at a low pressure. Moreover, connected to the pumping chamber is a valve 19 which is electromagnetically operated, the supply of current to the valve being controlled by a fuel control system to be described.

During inward movement of the plunger 16 and when the port 18 is covered, fuel will be displaced from the pumping chamber 14. If the valve 19 is in its operated (closed) state, fuel will flow to the injection nozzle 10 but if the valve 19 is in its inoperative state, the fuel will flow to a drain.

In one arrangement of the fuel supply system there are as many high pressure pumps 15 and associated valves 19 as there are injection nozzles so that in the particular example, four high pressure pumps would be supplied together with four valves. As an alternative, a mechanically operated hydraulic distributor can be utilized to deliver the output of one high pressure pump to the injection nozzles in turn and in this case only one valve 19 is required.

Turning now to FIG. 2, there is shown a control system for use with the fuel supply system of FIG. 1 that is to say a system which employs four high pressure pumps and associated valves.

In order to increase the operating time of the valves 19 it is proposed to prevent fuel flow to one injection nozzle of the series in sequence. This would mean that over a period of a number of engine cycles, the overall quantity of fuel supplied to the engine would be reduced and therefore the power output of the engine would be reduced. In order to maintain the power output of the engine those injection nozzles which receive fuel deliver sufficient extra fuel to ensure that the power output of the engine remains substantially the same. It is proposed that the engine speed should be above a predetermined value and the mean level of fuel below an upper predetermined value before the cessation of fuel supply to one injection nozzle should take place.

The system includes a first comparator 20 which receives an engine speed or pump speed signal from a transducer 21. The speed signal is compared with a reference signal provided by a reference source 22 and when the engine speed is above the value determined by the reference source 22, an output is obtained from the comparator and is supplied to one input of an AND gate 23. A second comparator 24 is provided and this receives a fuel demand signal from a circuit 25 which may be a governor circuit responsive to a number of parameters for example engine speed, and driver demand. The output of the circuit 25 is supplied to one input of the comparator 24 which at its other input receives a signal from a reference source 26. When the demanded fuel signal is below the value set by the reference source 26, an output is obtained from the comparator 24 and this is applied to the other input terminal of the AND gate 23. When therefore the engine speed is above the predetermined value set by the source 22 and the level of fuel is below the level set by the source 26, an output signal is obtained from the AND gate and is utilized as a switch control signal, to control an electronic switching circuit 27.

When the engine speed is below the value determined by the source 22 or the fuel demand is above the value set by the source 26, no output is obtained from the AND gate and the switch connects the output of the circuit 25 to a logic circuit 28 which determines the length of time the valves 19 should be operated and also the instant of operation. The circuit 28 receives engine position signals from a transducer 29 and the output of the circuit is applied to one input of an AND gate 30 the other input of which is connected to the output of an OR gate 31. One input of the OR gate is connected to the output of an inverter 32 the input of which is connected to the output of the AND gate 23 so that when no output signal is obtained from the AND gate indicative that normal operation is required, an input is applied to the OR gate which in turn applies an input to the AND gate 30. The output of the AND gate is fed to a so-called electronic distributor 33 which is also supplied with an input from the transducer 29. The outputs of the distributor are connected to the valves 19 respectively.

In operation and assuming of course that normal operation of the injection nozzles is required the signals from the logic circuit 28 will pass directly to the distributor 33 together with the engine position signals and fuel will be supplied to the injection nozzles 10–13 inclusive, in turn. Each injection nozzle should therefore deliver the same amount of fuel to the associated combustion chamber.

Normal supply of fuel to the engine will be obtained providing there is no output from the AND gate 23. Under wide engine operating conditions therefore normal fuel supply will take place for example, under full load conditions normal supply will take place irrespective of the engine speed and similarly at low engine speeds normal fuel supply will take place irrespective of the amount of fuel being supplied to the engine. If however the comparators 20 and 24 both produce an output, an output signal will be obtained from the AND gate 23 and this will be supplied to the switching circuit 27 to switch it to its alternative setting. Furthermore, the inverter 32 will cease to supply an enabling signal to the OR gate 31. When the switch 27 is in its alternative state, the fuel demand signal generated by the circuit 25 is modified before being passed to the logic circuit 28.

The actual fuel demand signal from the circuit 25 is passed to a selection circuit 34 which assesses the extent of modification to the sequence of operation of the injection nozzles which is required and the output of the circuit 34 is applied to a circuit 35 which has an input connected to the circuit 25 and its output connected when the switch 27 is in its alternative state, to the logic circuit 28. The selection circuit 34 and the circuit 35 determine the increased amount of fuel which it is necessary to supply through each injection nozzle in order to make up for the fact that in a cyclic manner, one injection nozzle ceases to supply fuel. The output of the circuit 35 will therefore be higher than its input and the circuits 34 and 35 can and, in the particular example, are arranged to provide for at least two different nozzle operating sequences.

The output of the selection circuit 34 is applied as a status signal to a sequence determining circuit 36 which also receives the engine position signals from the transducer 29. The circuit 36 conveniently comprises a number of shift registers appropriate to the injection sequences which can be selected by the selection circuit 34 respectively. Each shift register includes a mask whereby the signals supplied from the transducer 29 are outputted to the OR gate 31 in a particular injection sequence.

For example, the first shift register may be arranged in the case of a four cylinder engine, such that every third signal from the transducer 29 is not outputted to the OR gate. The second shift register may be arranged so that every fifth signal from the transducer 29 is not outputted to the OR gate and so on. When there is no output from the circuit 36 there is no output from the AND gate 30 so that even though a particular valve 19 has been selected by the distributor circuit 33 and even though an energising pulse is supplied by the logic circuit 28, that valve will not be supplied with energising current. The remaining valves will be energised in their turn for a slightly extended period of time so that the average valve of the fuel supply to the engine remains the same. The effect of the circuit 36 is that the injection nozzles take it in turn not to supply fuel.

In the example quoted the first register would be brought into operation at the lowest fuel level since it provides for the maximum number of "missed" injections possible over an extended period of engine operation. The second register would be brought into operation at a higher fuel level because the number of "missed" injections over the aforesaid extended period is lower.

In the case of an engine with a different number of engine cylinders, the sequences would be different but nevertheless, it can be arranged that the combustion chambers of the engine in turn fail to receive fuel. The fact that a combustion chamber receives no fuel for one working stroke does mean that its temperature will fall slightly but this slight fall is not sufficient to materially affect combustion of fuel the next time fuel is supplied. The fact that the valves assocated with those injection nozzles which do receive fuel are operated for an extended period of time means that more accurate fuel control is obtained from those nozzles and the overall efficiency of the engine is improved by operating the combustion chambers when they are supplied with fuel, at an increased load level.

It will be noted that for example as the demand on the engine is increased by the operator so that more fuel is required to be supplied to the engine, the adjustment of quantity as a change in the sequence of operation of the injection nozzles takes place, also takes place at the same time. There is therefore no noticeable change in the output power of the engine when a new injection sequence is selected.

It will be understood that the function of many of the individual circuits may be effected by a microprocessor with appropriate software.

The system which is shown in FIG. 2 can be very easily applied to the type of fuel system in which only one valve 19 and one high pressure pump are employed. All that is required is the deletion of the electronic distributor circuit 33 with the output of the AND gate 30 being connected to a drive circuit which supplies current to the valve when a signal is present at the output of the AND gate.

In the example the engine is a four cylinder engine and only one nozzle is rendered inoperative at a time. In an engine having an increased number of cylinders where two combustion spaces of the engine receive fuel at the same time, it is possible to arrange that two injection nozzle fail to deliver fuel.

I claim:

1. A fuel control system for a fuel supply system for a multi-cylinder internal combustion engine of the compression-ignition type, the fuel supply system including at least one electromagnetically operated valve which is operated to cause fuel to be supplied to the combustion chambers of the associated engine, the fuel control system comprising first means responsive to engine position signals and to a fuel demand signal for providing a sequence of control signals for said valve, second means including an AND gate for driving said valve, one input of said AND gate receiving said sequence of control signals, an OR gate having its output connected to the other input of said AND gate, fuel demand comparison means and speed comparison means for comparing the actual fuel demand and the actual speed with fuel demand and speed reference signals, respectively, a further AND gate responsive to said fuel demand and speed comparison means and producing an output when the speed is above a predetermined value, switch means responsive to the output of said further AND gate and through which the fuel demand signal is supplied to said first means when the speed is below said predetermined value and the fuel demand is above said predetermined value and for supplying an extended fuel demand signal when the speed is above said predetermined value and the fuel demand is below said predetermined value, fuel demand modifying means for producing said extended fuel demand signal in response to a status signal, a sequence selection circuit responsive to the fuel demand signal for producing said status signal, the value of said status signal determining the extended fuel demand signal, circuit means responsive to said status signal and said engine position signals for supplying a series of sequence signals which coincide with said control signals, to one input of said OR gate, the other input of said OR gate being connected to receive the inverted output of said further AND gate, said series of sequence signals having every $n^{th}$ one signal omitted to prevent operation of the valve, n being an odd number in the case of an engine having an even number of cylinders and the value of n depending on said status signal whereby, when the engine speed is above said predetermined value and the fuel demand is below the predetermined value, the firing of every $n^{th}$ cylinder of the engine will be prevented.

2. A fuel control system according to claim 1, in which said circuit means comprises a plurality of shift registers corresponding to the values of the status signal produced by the sequence selection circuit, each shift register having a mask corresponding to a predetermined engine cylinder operating sequence.

3. A fuel control system according to claim 1 in which said second means includes an electronic distributor which distributes control signals to a plurality of said valves in turn.

4. A fuel control system according to claim 2 in which said second means includes an electronic distributor which distributes control signals to a plurality of said valves in turn.

* * * * *